US007360761B2

(12) United States Patent
Durham et al.

(10) Patent No.: US 7,360,761 B2
(45) Date of Patent: Apr. 22, 2008

(54) DYNAMIC GENERATION OF A PROFILE FOR SPINNING REEL GAMING MACHINES

(75) Inventors: Timothy John Durham, Oak Park, IL (US); Niclas Jouko Antti, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 154 days.

(21) Appl. No.: 11/159,767

(22) Filed: Jun. 23, 2005

(65) Prior Publication Data

US 2005/0285337 A1 Dec. 29, 2005

Related U.S. Application Data

(60) Provisional application No. 60/582,591, filed on Jun. 24, 2004.

(51) Int. Cl.
*A63B 71/00* (2006.01)

(52) U.S. Cl. ..... 273/138.1; 273/143 R

(58) Field of Classification Search ..... 273/138.1
See application file for complete search history.

(56) References Cited

U.S. PATENT DOCUMENTS

| | | | | |
|---|---|---|---|---|
| 3,913,922 | A * | 10/1975 | Richards et al. | 273/143 R |
| 4,071,246 | A * | 1/1978 | Hooker | 273/143 R |
| 4,095,795 | A * | 6/1978 | Saxton et al. | 463/20 |
| 4,099,722 | A * | 7/1978 | Rodesch et al. | 273/143 R |
| 4,138,114 | A * | 2/1979 | Andersen | 273/143 R |
| 4,191,377 | A * | 3/1980 | Burnside | 273/143 R |
| 4,238,127 | A | 12/1980 | Lucero et al. | |
| 4,262,906 | A | 4/1981 | Heywood | |
| 4,299,388 | A | 11/1981 | Resch et al. | |
| 4,411,428 | A | 10/1983 | Nicolaus | |
| 4,421,310 | A | 12/1983 | Williams | |
| 4,492,379 | A | 1/1985 | Okada | |
| 4,534,560 | A | 8/1985 | Okada | |
| 4,618,150 | A | 10/1986 | Kimura | |
| 4,637,611 | A | 1/1987 | Hamada | |
| 4,660,833 | A | 4/1987 | Dickinson et al. | |
| 4,837,728 | A | 6/1989 | Barrie et al. | |
| 4,911,449 | A | 3/1990 | Dickinson et al. | |
| 4,912,389 | A | 3/1990 | Eguchi | |
| 5,058,893 | A | 10/1991 | Dickinson et al. | |
| 5,102,136 | A | 4/1992 | Heidel et al. | |
| 5,209,477 | A | 5/1993 | Heidel et al. | |
| 5,220,161 | A | 6/1993 | Geis et al. | |
| 5,423,540 | A | 6/1995 | Taxon | |

(Continued)

FOREIGN PATENT DOCUMENTS

| | | |
|---|---|---|
| GB | 1550732 | 8/1979 |

(Continued)

*Primary Examiner*—Eugene Kim
*Assistant Examiner*—Dolores R. Collins
(74) *Attorney, Agent, or Firm*—Schwegman, Lundberg & Woessner, P.A.

(57) ABSTRACT

A gaming machine having spinning reels and methods for operating the gaming machine use a reel controller that controls motion of the spinning reels according to spin profiles for each reel. Each spin profile may be provided by the game play design and may be realized using curve fitting techniques, such as Bezier curves, splines, or approximations with line segments.

23 Claims, 6 Drawing Sheets

U.S. PATENT DOCUMENTS

| | | | | |
|---|---|---|---|---|
| 5,683,296 | A | 11/1997 | Rasmussen | |
| 5,729,006 | A | 3/1998 | Maeda | |
| 5,839,957 | A | 11/1998 | Schneider et al. | |
| 5,938,196 | A | 8/1999 | Antoja | |
| 6,394,900 | B1 | 5/2002 | McGlone et al. | |
| 6,575,829 | B2 * | 6/2003 | Coleman et al. | 463/20 |
| 6,866,581 | B2 * | 3/2005 | Martinek et al. | 463/16 |
| 6,923,441 | B2 * | 8/2005 | Inoue | 273/143 R |
| 7,169,041 | B2 * | 1/2007 | Tessmer et al. | 463/16 |
| 2003/0114211 | A1 * | 6/2003 | White | 463/17 |
| 2003/0224858 | A1 * | 12/2003 | Yoseloff et al. | 463/43 |
| 2004/0254014 | A1 * | 12/2004 | Quraishi et al. | 463/29 |
| 2005/0255921 | A1 * | 11/2005 | Walker et al | 463/41 |
| 2006/0247050 | A1 * | 11/2006 | Mathis | 463/39 |
| 2007/0054730 | A1 * | 3/2007 | Mattice et al. | 436/16 |

FOREIGN PATENT DOCUMENTS

| | | |
|---|---|---|
| GB | 2072395 | 9/1981 |

* cited by examiner

| ELAPSED TIME | DELAY VALUE |
|---|---|
| 0 | 50ms |
| 50ms | 45ms |
| 95ms | 35ms |
| 130ms | 25ms |
| 155ms | 20ms |
| 175ms | 15ms |
| 190ms | 10ms |

DYNAMIC GENERATION OF A PROFILE FOR SPINNING REEL GAMING MACHINES

RELATED APPLICATION

This application claims priority under 35 U.S.C. 119(e) from U.S. Provisional Application Ser. No. 60/582,591 filed 24 Jun. 2004, which application is incorporated herein by reference.

FIELD OF THE INVENTION

The present invention relates generally to gaming machines, and more particularly, to spinning reel type gaming machines.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2005, WMS Gaming, Inc. All Rights Reserved.

BACKGROUND

In general, standard mechanical gaming machines include a plurality of reels with symbols around the perimeters of the reels. In the course of normal game play the reels are spun and stopped at a given reel stop position. Stepper motors, through the use of a motor controller and under the control of the gaming machine firmware, drive the reels. Stepper motors, or steppers, have been described as electric motors without commutators. See, for example, "Control of Stepping Motors, A Tutorial" by Douglas W. Jones, The University of Iowa Department of Computer Science at internet site http://www.cs.uiowa.edu/~jones/step/. Steppers consist of a plurality of windings that are all part of a stator and a rotor that may be a permanent magnet. For variable reluctance motors, the rotor may be a toothed block of a magnetically soft material. A motor controller externally handles the commutation. Design of these motors and controllers allows the motor to be held in a fixed position as well as being rotated. Many steppers can be operated at audio frequencies, allowing them to spin quickly. Further, some steppers may also be started and stopped quickly at controlled orientations.

The motor spins as the coils are driven in a sequence specified by the manufacturer. The rate at which the coils are sequenced determines the angular velocity of the motor. Changes in angular velocity of the reel-motor combination are limited by the moment of inertia of the motor and reel, along with the torque of the motor. Because of this limitation, the motor must be accelerated to its terminal velocity over some period of time. FIG. 1A shows a typical sequence that can be used in a gaming machine such as gaming machine 10 of FIG. 1B, where gaming machine 10 has five reels 12.

The reel sits initially at rest. It is commanded to instantaneously begin spinning at initial velocity, $v_i$. The velocity is increased linearly over the period $T_l$ until the final velocity, $v_f$, is reached. The reel runs for some period of time at velocity $v_f$ until it is decelerated, coming to rest at the reel stop position chosen by the game firmware. Traditionally, during the acceleration and deceleration phases the step rate is controlled by a microprocessor through the use of lookup tables stored in memory. The lookup table contains entries that represent the amount of time to delay between each step. By shortening the time from one step to the next the reel will accelerate. By holding the time constant from one step to the next the reel will run at a constant velocity. By lengthening the time from one step to the next the reel will decelerate. FIG. 2 shows a table of a typical acceleration sequence.

At time t=0, the microprocessor issues a step pulse to the motor controller. The microprocessor then gets the first delay time value from its lookup table, 50 ms in the table of FIG. 2. The microprocessor uses this delay time to set a timer. When the timer expires, another step pulse is issued, the next delay value is fetched from the lookup table, and the timer is reset using this fetched delay time. This sequence continues until the end of the table is reached. This scheme is limited to a single acceleration or deceleration profile per table. In order to achieve fine control, these tables may grow to be quite large. The number and size of these tables will be limited by the storage capacity of the memory accessed by the microprocessor.

SUMMARY

The above mentioned problems are addressed by the present invention and will be understood by reading and studying the following specification. In embodiments, a gaming machine and methods for operating the gaming machine include a reel controller, a reel driver, and a reel in which the reel is driven based on motion parameters associated with a spin profile for the reel. In various embodiments, these motion parameters may include reel velocities or reel accelerations provided dynamically from the spin profile.

These and other aspects, embodiments, advantages, and features will become apparent from the following description and the referenced drawings.

DETAILED DESCRIPTION

In the following detailed description of the invention, reference is made to the accompanying drawings which form a part hereof, and in which are shown by way of illustration, specific embodiments in which the inventions may be practiced. These embodiments are described in sufficient detail to enable those skilled in the art to practice the present invention. Other embodiments may be utilized and structural, logical, and electrical changes may be made without departing from the scope of the invention. The various embodiments disclosed herein are not necessarily mutually exclusive, as some disclosed embodiments can be combined with one or more other disclosed embodiments to form new embodiments. The following detailed description is, therefore, not to be taken in a limiting sense, and the scope of the embodiments of the present invention is defined only by the appended claims, along with the full scope of equivalents to which such claims are entitled.

As used herein, the term "gaming machine" refers to a machine into which a coin or token is deposited, and/or which is activated by a card or token associated with data regarding non-monetary chattel, to play a game that uses a video display and/or an electromechanical device with a spinning reel. The gaming machines include slot machines and push button machines. The gaming machines include coin operated machines and machines having a serial interface. Gaming machines also include gaming tables capable of being initiated by a card or token.

Figure 1A:
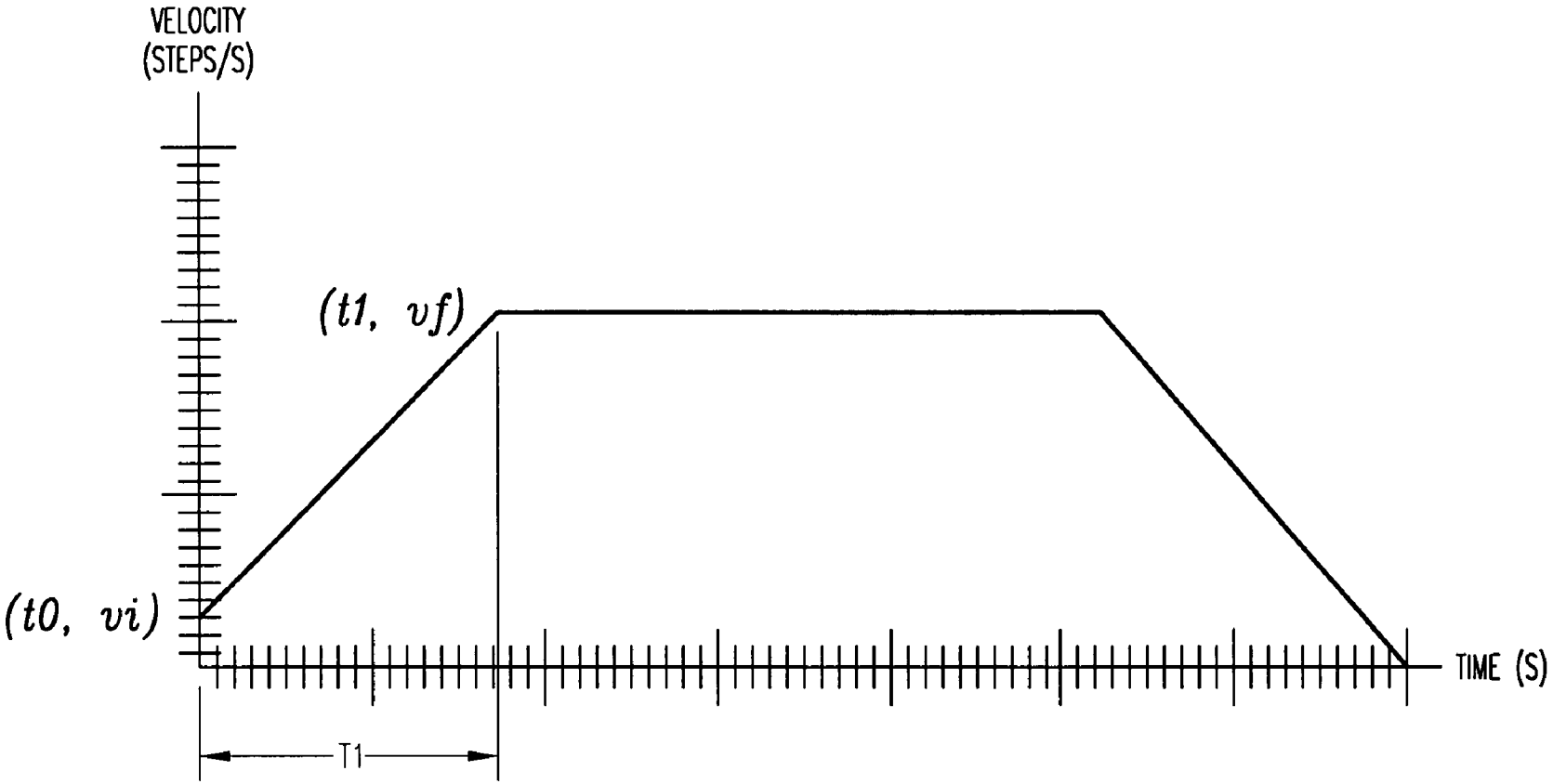
FIG. 1A (PRIOR ART)
FIG. 1A shows a typical sequence associated with accelerating a motor to its terminal velocity over some period of time.
Figure 1B:
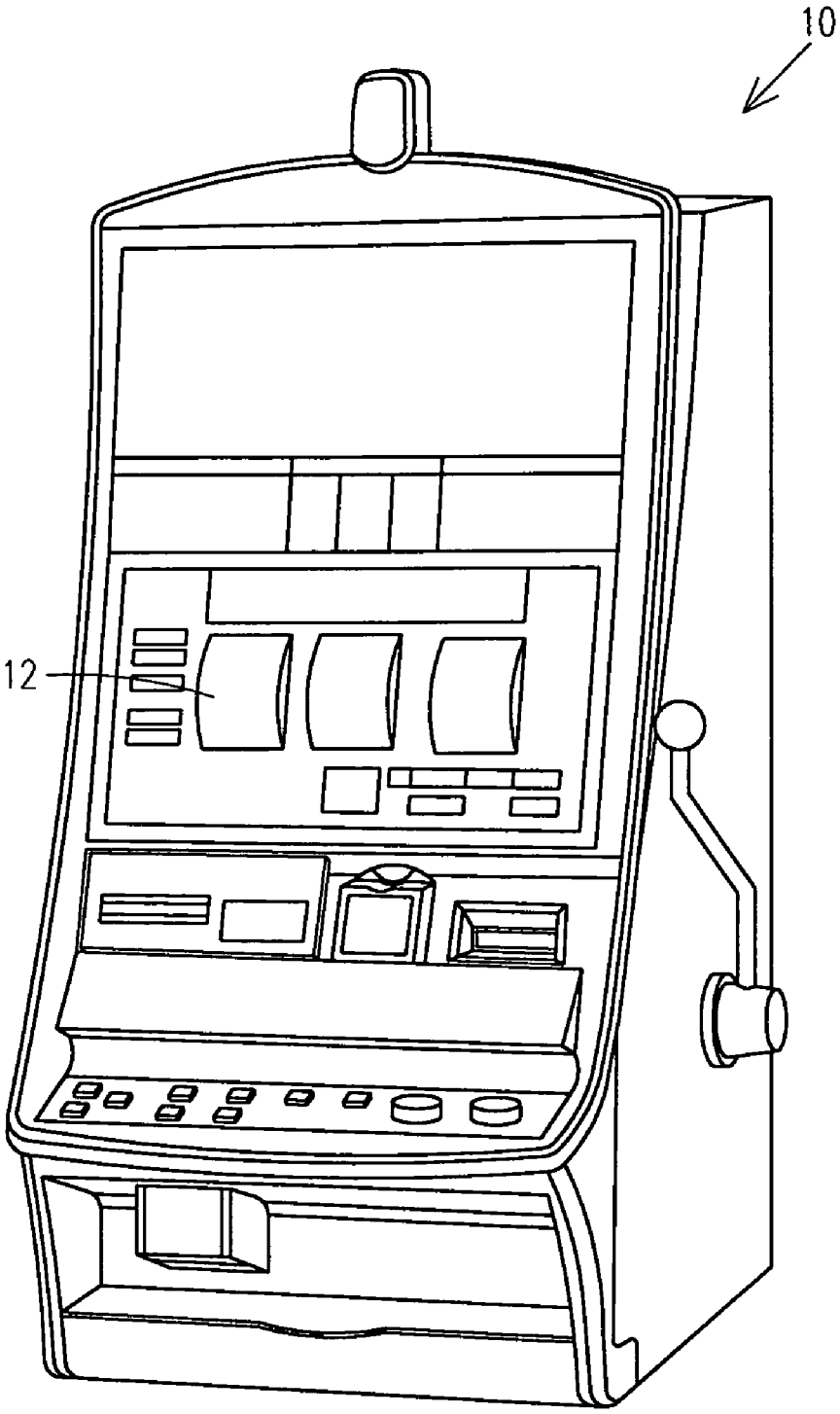
FIG. 1B (PRIOR ART)
FIG. 1B shows a gaming machine having five reels.
Figures 2, 3:
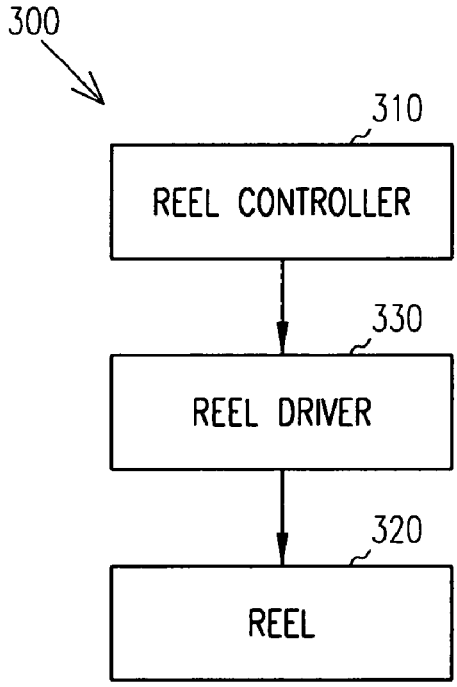
FIG. 2 (PRIOR ART)
FIG. 2 shows a table of delay values used in a typical acceleration sequence.
FIG. 3 shows a block diagram of an embodiment of a gaming machine that includes a reel controller, a reel, and a reel driver, according to the teachings of the present invention.

FIG. 3 depicts a block diagram of an embodiment of a gaming machine 300. Gaming machine 300 includes a reel controller 310, a reel 320, and a reel driver 330. Reel controller 310 manages reel driver 330 to drive reel 320 based on motion parameters assigned to a time period associated with a spin profile for reel 310. These motion parameters may be assigned to the start and finish of a selected time period.

Motion parameters for a reel spin include those parameters that are used to control, manage, or establish motion of the reel spin according to a spin profile. The motion parameters may include velocity or acceleration values at a given time or times selected from points on a spin profile. In an embodiment, reel controller 310 provides a set of paired motion parameters, where each paired motion parameter is correlated to a start and a finish of one of a set of time periods. These paired motion parameters may include a velocity at the start of the time period and a velocity at the finish of the time period along with an acceleration. The set of paired motion parameters may be associated with endpoints of line segments that approximate the desired spin profile for the reel. In an embodiment, the motion parameters are associated with a set of curves that approximates a desired profile for a reel spin in which for each curve a velocity is assigned from the curve, an end time or time length for the curve is assigned. The set of curves may be realized as a set of linear segments. However, the set of curves is not limited to linear segments, but may be any set of curves that approximates the desired profile and provides for ease of determination of reel motion from a set of motion parameters assigned from this set of curves. For example, Bezier curves or splines may be used.

In an embodiment, a spin profile is provided for each game or game mode that is played, or run, on the gaming machine. Motion parameters may be provided dynamically through calculations as game play progresses or provided from memory and fetched as the game play progresses. In an embodiment, each reel 320 of a number of reels is controlled or managed by reel controller 310 and driven by its associated reel driver 310. Reel controller 310 may control each of a number of reels independently.

Figure 4:
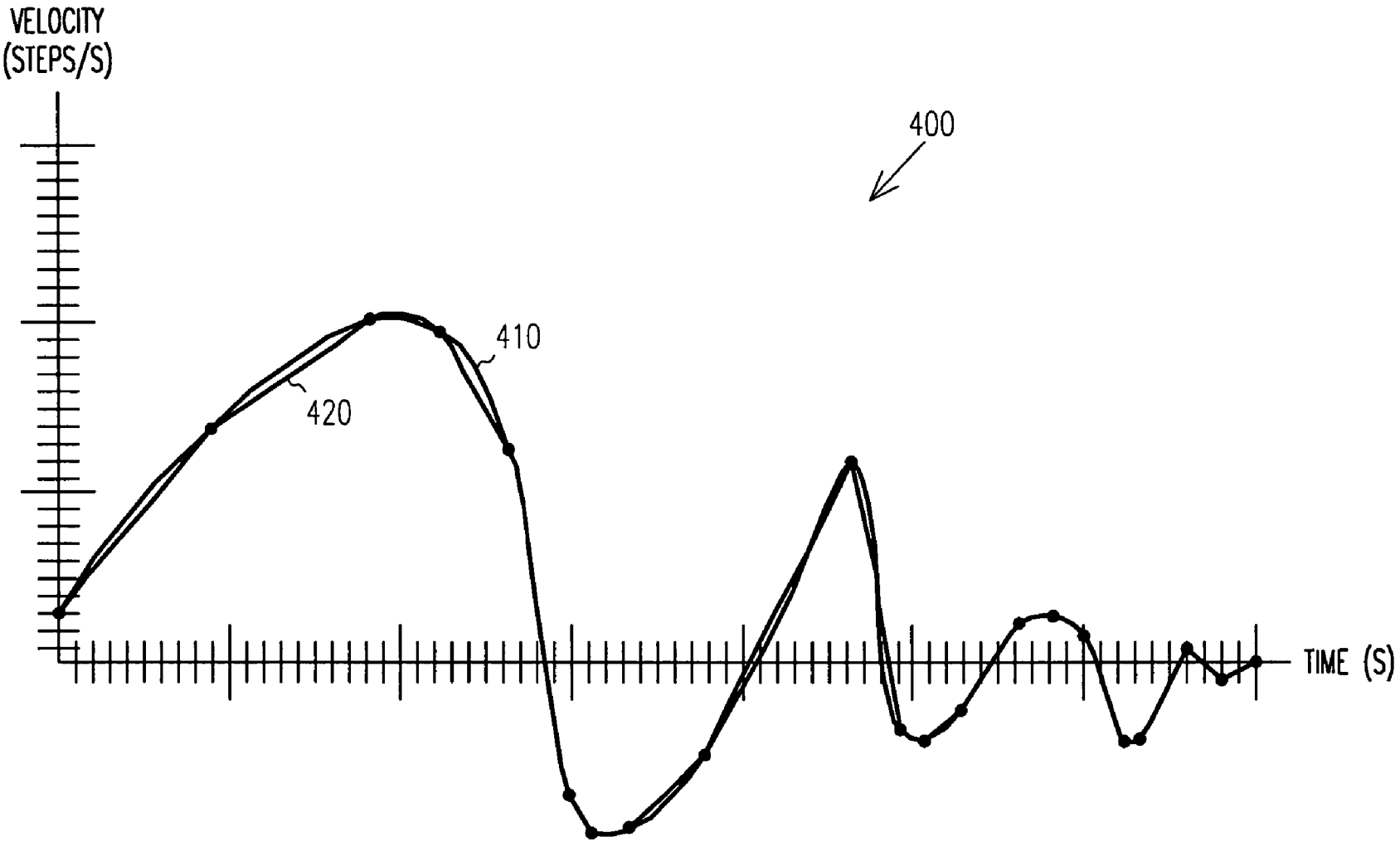
FIG. 4 shows an embodiment of a spin reel profile that may be implemented using an embodiment of a gaming machine as discussed with respect to FIG. 3, according to the teachings of the present invention.

FIG. 4 shows an embodiment of a reel spin profile 400 that may be implemented using an embodiment of a gaming machine 300 as discussed with respect to FIG. 3. Reel spin profile 400 is shown as two curves, a desired reel control profile 410 and an approximate reel profile 420. The desired reel control profile 410 is substantially smooth and represents the desired profile for controlling the reel according to a specified game for the gaming machine. In various embodiments, at some points or intervals in time, the velocity may be negative. The negative velocity represents a change in rotational direction. Such a profile as that of desired reel control profile 410 shown in FIG. 4 would be very difficult to attain by manually creating a typical lookup table containing delay values that would cause the reel to behave in the manner as desired reel control profile 410. Further, the amount of data could easily become prohibitively large for the typical table lookup approach. An embodiment using approximate reel profile 420 to approximate or represent the curve of desired reel control profile 410 with line segments may provide a dynamic approach that avoids the data intensive approach of typical table lookup scenarios.

In the embodiment shown in FIG. 4, desired reel control profile 410 is effectively realized using approximate reel profile 420 that includes a number of line segments. Each line segment is completely defined by two points according to the equation of a line: $y=mx+b$, where m is the slope of the line and b is the y-intercept. This equation allows all points along the line to be derived. For each line segment of approximate reel profile 420:

$y \rightarrow v$, where $v$ is velocity, $x \rightarrow t$, where t is time, $m=a$, where a is acceleration, and $b=v_0$, where $v_0$ is velocity at time $t=0$, where the equation for each line segment becomes $v=at+v_0$. The slope given by the acceleration, a, is related to the velocity, $v$, as $a=dv/dt$, that is, the acceleration is equal to a change in velocity with respect to time. This slope for a given velocity vs. time line segment can be calculated as, $$a=(v_f-v_i)/(t_f-t_i),$$

where $v_f$ is final velocity, $v_i$ is initial velocity, $t_f$ is the time when the final velocity is reached, and $t_i$ is the time when the initial velocity begins for the given velocity vs. time line segment. As can be appreciated by those skilled in the art, with the desired velocity known over a given period of time, control of the step motor may be realized.

In an embodiment, with velocity given in steps/s, a relationship between the delay value for the step motor and the velocity can be taken to be $dt=steps/v$, taking $v$ as positive for simplicity. In order to keep track of time and velocity units (seconds and steps/second), the symbol $\mu$ is used to denote a unit step (one step), where one can write the step delay as $dt=\mu/v$. For a selected line segment of the control spin reel profile, with the point $P_0=(t_0, v_0)$ on the line $v=at+v_i$, the next point $P_1=(t_1, v_1)$ is calculated to also satisfy $v=at+v_i$. To correlate to the stepping of the motor, the next point is selected as that point that corresponds to a unit step for which $v_1$ is related to the delay value at $P_0$ by $v_1=\mu/dt_0$, where at $P_0$, $dt_0=t_1-t_0$. With $v_1=\mu/dt_0$, substitution into the line equation provides $v_1=adt_0+v_0=>v_1=a(\mu/v_1-t_0)+v_0$. Solving for $v_1$ yields:

$$v_1=(v_0-at_0)/2+/-\mathrm{sqrt}((v_0-at_0)^2/4+\mu a) \quad (1)$$

Equation (1) may be used repeatedly for computation when traveling the line segment.

In an embodiment with the velocity $v_0$ and delay value $dt_0$ at a point $P_0=(t_0, v_0)$ known, the next point and delay value may be calculated as:

$$P_1=(t_0+1/v_{0,v0}+1/dt_0) \quad (2)$$

$$dt_1=1/(v_0+1/dt_0) \quad (3)$$

In this embodiment, the repeated computation of a form of Equation (1) is not required, since, while "traveling" the segment, equations (2) and (3) can be used. However, since $1/v$, for small values of $v$, would be very large (infinite for $v=0$), the first delay value of a segment may be calculated using equation (1). Additionally, the segment under calculation may be brought to the origin, $t_0=0$, and equation (1) can be simplified to:

$$v_1=v_0/2+\mathrm{sqrt}(v_0^2/4+\mu a) \quad (4)$$

Above the segment level, i.e. the profile level, which is made up of multiple segments, there are further considerations due to the discrete nature of the delay values. The total sum of generated delay values for a segment will not necessarily match the total time of the segment used to approximate the desired control reel profile over the time period of the line segment. In some embodiments, it may be important to avoid sudden changes in acceleration, other than those dictated by the segments. This can be achieved in several ways. In one approach, a constraint is set on the segments, which can thus be pre-checked to conform to the delay generation scheme. Another approach includes handling a mismatch between the end of a profile segment and the end of a number of delay values in the following manner. Delays for a segment are generated until generating one more would bring the total sum of delays beyond the total time of the segment. The difference ("unused time") is added to the next segment. In an embodiment, the unused time can be added to the next segment by moving its start point backwards (in time) by the value of the difference. This starting point shift has the effect of slightly lowering the acceleration of the next segment, but not increasing it.

Other embodiments can be realized that approximates a reel spin profile defined by a game play design with a set of curves that allows real time calculation of velocities, acceleration, and/or other motion parameters to control a spin reel to provide motion as defined by the game play design. In an embodiment, a method includes providing a set of motion parameters in a reel controller of a gaming machine, and driving a reel based on the set of motion parameters. The set of motion parameters may include a first motion parameter correlated to a start of a time period and a second motion parameter correlated to a finish of a time period, where the time period is associated with a time period of a spin profile for the reel. Alternately, the set may include a starting velocity along with a finishing velocity and/or an end time or period length of a selected time period of the spin profile. In an embodiment, the reel spin profile is approximated with a set of linear segments. In an embodiment, the set of motion parameters during procession through a time period is calculated in real time in a reel controller. Alternately, the set is calculated in a main processor for the gaming machine and downloaded to a reel controller of the gaming machine. In an embodiment, a starting set of motion parameters that defines line segments that approximate the spin profile for the reel are read from a memory.

In order to facilitate creative game designs, the reel control system must support complex theme based spin behaviors. As an example, for an earthquake game theme it may be desirable to have the reels shake and shudder about a given stop position. In a car chase game theme, the gaming machine would spin the reels at varying speeds with sudden changes in both speed and direction as the car chase unfolds. Such configurations may be supported by an embodiment of a gaming machine having reel controllers that can dynamically manage the actuation of each reel with respect to a spin profile for that reel as provided by the game design.

Figure 5:
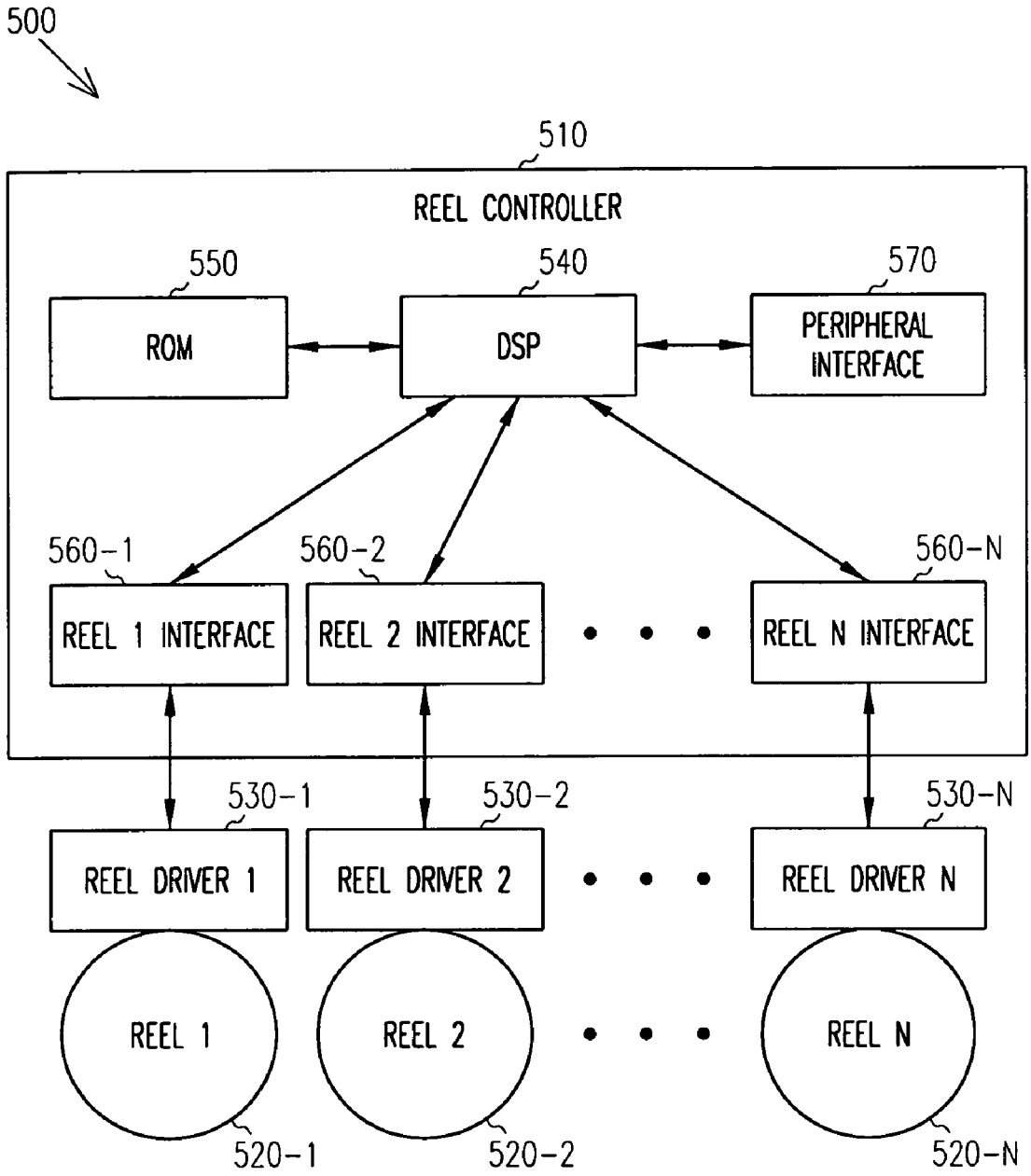
FIG. 5 depicts a block diagram of an embodiment of a gaming machine having a reel controller, a number of reels, and a number of reel drivers in which the reel controller uses spin profiles to manage the operation of the number of reels, according to the teachings of the present invention.

FIG. 5 depicts a block diagram of an embodiment of a gaming machine 500 having a reel controller 510, a number of reels 520-1, 520-2, . . . 520-N, and a number of reel drivers 530-1, 530-2, . . . 530-N in which reel controller 510 uses spin profiles to manage the operation of the number of reels 520-1, 520-2, . . . 520-N. In an embodiment, five reels are used in gaming machine 500. However, gaming machine 500 is not limited to using five reels. Controller 510 includes a processor 540 and memory 550 that that correlates motion parameters to realize the spin profiles associated with a game embedded in gaming machine 500. In an embodiment, the spin profiles are realized as a set of interconnected line segments. In an embodiment, processor 540 is a digital signal processor, DSP. In various embodiments, other forms of processors may be implemented as processor 540. In an embodiment, memory 550 is read only memory, ROM. In various embodiments, other forms of memory may be implemented as memory 550.

In an embodiment, each reel driver 530-1, 530-2, . . . 530-N is responsive to reel controller 510 to drive a corresponding one of the number of reels 520-1, 520-2, . . . 520-N based on motion parameters assigned to a time period associated with a spin profile for each reel. In an embodiment, the motion parameters are assigned to a start and a finish of a time period of the spin profile. In an embodiment, reel controller 510 communicates with each reel driver 530-1, 530-2, . . . 530-N via a corresponding reel interfaces 560-1, 560-2, . . . 560-N, respectively. Alternately, a single reel interface may be coupled to the processor 540 to communicate with the reel drivers 530-1, 530-2, . . . 530-N, where the single reel interface has logic to independently interact with each reel driver.

In an embodiment, reel controller 510 includes a peripheral interface 570 to receive information and instructions from a source external to reel controller 510. Peripheral interface 570 may include a RS485 serial port or other standard serial or parallel port according to its gaming application. In various embodiments, the received information may include information regarding motion parameters for each of the reels 520-1, 520-2, . . . 520-N. Peripheral interface 570 provides a mechanism for the system, gaming machine 500, to support the ability to download points of interest to processor 540. These points of interest can be points on a complicated waveform representing a desired spin profile, such as a non-periodic fluctuating waveform with a large number of transitions. This desired profile may be approximated by selectively using points where the slope of the desired waveform goes to zero.

These points of interest may be stored in reel controller 510 or downloaded to reel controller 510 at run time. Given these points of interest as endpoints for line segments, reel controller 510 may determine the number of steps it needs to lay out between each of those points of interest. These end points may be calculated ahead of time, that is, prior to running game play on game machine 500. These endpoints for the spin profile may be stored in reel controller 510 or they may be stored with game data. With the spin profile or these endpoints defined by the spin profile stored with game data, reel controller 510 for the stepper motors remains generic and able to adapt to whatever the game is implemented in gaming machine 500. In an embodiment, instead of storing the waveform values from one step to the next, the data stored includes velocity values and acceleration values, or times that can be used to progress from one velocity to the next.

Figure 6:
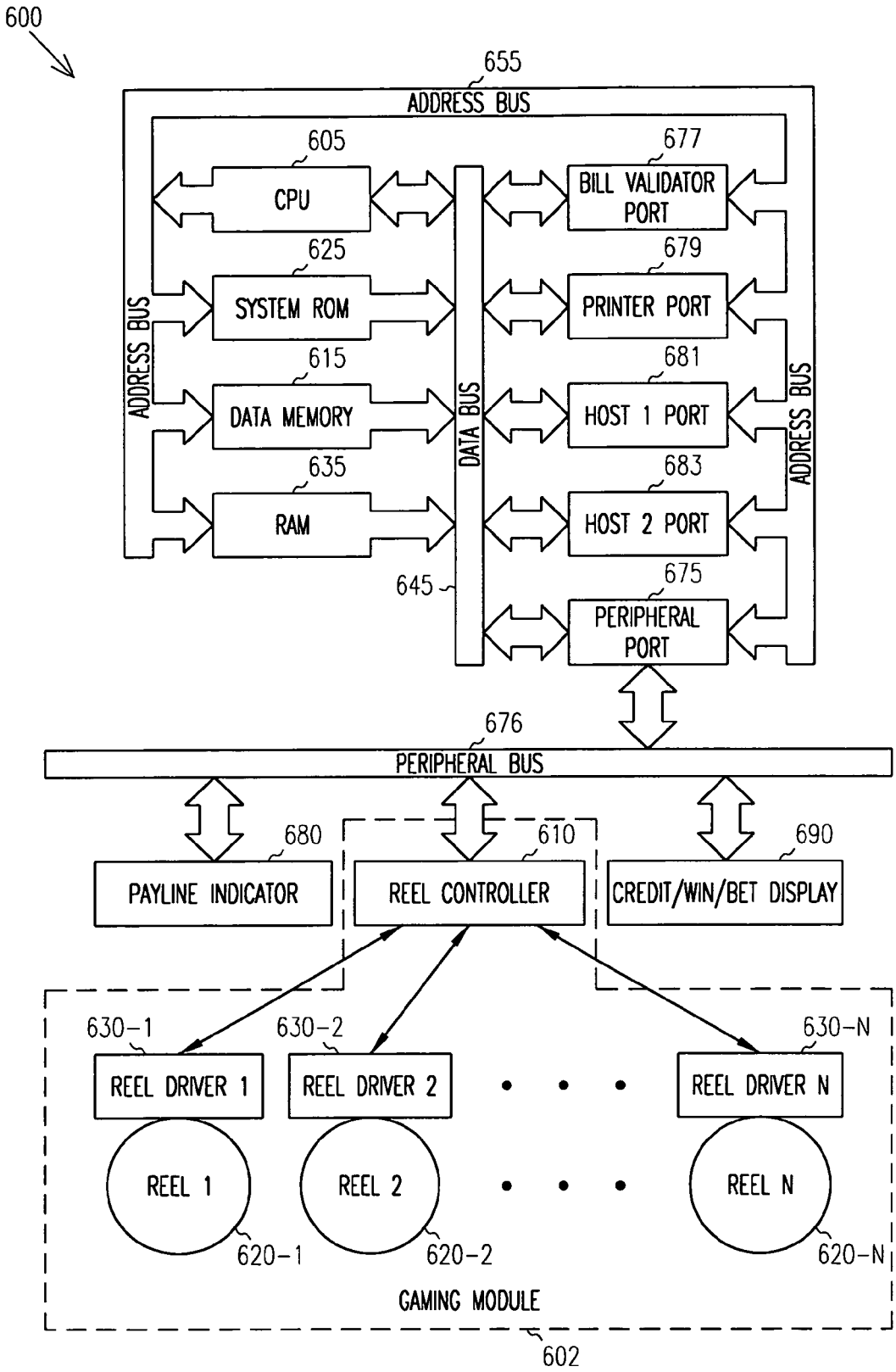
FIG. 6 depicts a block diagram of an embodiment of a gaming machine having a gaming module and a central processing unit in which the gaming module operates dynamically in response to spin profiles correlated to various games associated with the gaming machine, according to the teachings of the present invention.

FIG. 6 depicts a block diagram of an embodiment of a gaming machine 600 having a gaming module 602 and a central processing unit 605 in which gaming module 602 operates dynamically in response to spin profiles correlated to various games associated with the gaming machine 600. Central processing unit 605, CPU 605, may be realized as a microprocessor or any other processor or control unit. Gaming machine 600 includes data memory 615 that stores various information related to gaming machine 600 including parameters for operating gaming machine 600 to play a number of games. Information stored in data memory 615 may include motion parameters correlated to spinning reel profiles associated with each spinning reel of gaming machine 600 for each game parameter or game modes for which gaming machine 600 is adapted to play. Data memory 615 may be realized as ROM or any other memory device capable of storing game and gaming machine parameters.

Gaming machine 600 may include, but is not limited to, additional system components such as system ROM 625 and RAM 635 coupled to a data bus 645 and an address bus 655. Data bus 645 and address bus 655 may be configured in any of various manners to provide a transmission path for communication within gaming machine 600. Gaming machine 600 may also include peripheral port 675, a bill validator port 677, a printer port 679, as well as additional ports such as host 1 port 681 and host 2 port 683. Each additional system component may be associated with an address for control and communication from CPU 605. Information is transmitted through gaming machine 600 as data via data bus 645 to the various system components identified by an address that is provided on address bus 655. Gaming machine 600 may be operated similar to a computer system, but is not limited to a configuration in which components are coupled to a data bus and address bus.

The main control, CPU 605, for gaming machine 600 is coupled to modules providing visual information to a user, or player, such as payline indicator 680, credit/win/bet display 690, and gaming module 602. Gaming module 602 may be coupled to CPU 605 in various configurations. In an embodiment, gaming module is coupled to CPU 605 by a peripheral bus 676. Peripheral bus 676 may be coupled to peripheral port 675 that uses data bus 645 and address bus 655 for information flow from the CPU 605 to peripheral bus 676. Peripheral port 675 may include a RS485 serial port or other standard serial or parallel port according to its gaming application. Payline indicator 680 and credit/win/bet display 690 may also be coupled to peripheral bus 676. Alternately, gaming module 602 may have an address and may be configured to receive information in coordination with CPU 605 by coupling to data bus 645 and address bus 655. Alternately, peripheral bus 676 may be coupled to address bus 655 and data bus 645 to transfer information between CPU 605 and reel controller 610.

Gaming module 602 includes a number of reels 620-1, 620-2, . . . 620-N each of which includes a number of symbols where at least one symbol per reel is visible to a user at a stop or play position. In an embodiment, gaming module 602 includes five reels. However, gaming machine 600 and/or gaming module 602 are not limited to five reels. Each reel 620-1, 620-2, . . . 620-N is driven by one of a number of reel drivers 630-1, 630-2, . . . 630-N, respectively. Each reel driver 630-1, 630-2, . . . 630-N is responsive to a reel controller 610. Each reel driver 630-1, 630-2, . . . 630-N may be coupled directly to reel controller 610, coupled to reel controller 610 through a reel interface that handles a number of reel drivers, or coupled to reel controller through a number of reel interfaces with one reel interface per reel driver.

In an embodiment, gaming machine 600 has an area in which game data is provided that can be changed according to a given game scenario. Reel controller 610 may be generic with port connection between the main game CPU 605 and reel controller 610 in which reel controller 610 has a DSP to process data provided from CPU 605. CPU 605 processes system and game information and downloads processed data to reel controller 610. Reel controller 610 may perform linear interpolation using data from CPU 605 and manages the operation of the stepper motors associated with the reels according to the game profiles for the spinning reels. In an embodiment, reel controller 610 manages five reels simultaneously. Reel controller 610 is not limited to managing five reels but may manage any number of reels.

In an embodiment, CPU 605 may perform calculations to provide velocity, acceleration, and/or delay time data to reel controller 610 to approximate a control spin reel profile. The control spin reel profile is stored in data memory 615 and correlated to a game or game mode. CPU 605 downloads data to reel controller 610 to drive each reel 620-1, 620-2, . . . 620-N according to the specific spin reel profile for each spin reel. CPU 605 downloads the data as needed in real time according to the scenarios associated with the game play in the game or game mode operating at the current time.

In an embodiment, a gaming machine and methods for operating the game machine use a stepper motor in which the calculation of the delay values is performed in real time as opposed to ahead of time. Given a current velocity and knowledge of a desired velocity status in some period of time, each step to get from the current velocity to the desired velocity is linearly interpolated. In an embodiment a digital signal processor which operates as a very fast microprocessor is used to make these linear interpolation calculations in real time, while the motor is stepping. The digital signal processor may issue a step to reel driver and, then, for the period for the next step, it would calculate how long it would have to delay. As the digital signal processor controls the application of the delay, once the next step is issued, the digital signal processor calculates the next delay and so on. In this manner, the digital signal processor controls spin reel motion according to each linear segment representing a spin profile.

Although specific embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. It is to be understood that the above description is intended to be illustrative, and not restrictive, and that the phraseology or terminology employed herein is for the purpose of description and not of limitation. Combinations of the above embodiments, and other embodiments, will be apparent to those of skill in the art upon studying the above description. The scope of the present invention includes any other applications in which the above structures and fabrication methods are used. The scope of the present invention should be determined with reference to the appended claims, along with the full scope of equivalents to which such claims are entitled.

What is claimed is:

1. A gaming machine comprising:

an input device to receive a wager to play a game;

a reel controller;

a reel including a plurality of symbols associated with the game; and a reel driver responsive to a plurality of drive signals from the reel controller to drive the reel based on motion parameters associated with a spin profile for the reel, the motion parameters including an initial velocity, a final velocity, and a time to reach the final velocity from the initial velocity, the reel controller configured to calculate, in real time, time intervals between the drive signals based on the initial velocity, the final velocity, and the time to reach the final velocity from the initial velocity.

2. The gaming machine of claim 1, wherein the reel controller is adapted to provide a set of paired motion parameters, each paired motion parameter correlated to one of a set of time periods.

3. The gaming machine claim 1, wherein the spin profile is approximated by Bezier curves or splines.

4. The gaming machine of claim 2, wherein the paired motion parameters include a constant acceleration.

5. The gaming machine of claim 1, wherein the motion parameters are mapped to line segments that approximate the spin profile for the reel.

6. The gaming machine of claim 1, wherein the reel controller uses dynamically provided motion parameters.

7. The gaming machine of claim 1, wherein the gaming machine further includes a plurality of reels, each reel driven by a respective one of a plurality of reel drivers, each reel driver responsive to the reel controller.

8. The gaming machine of claim 7, wherein each reel driver is associated with a set of paired motion parameters.

9. The gaming machine of claim 8, wherein the set of paired motion parameters for each reel driver is independent of the set of paired motion parameters of the other reel drivers of the plurality of reel drivers.

10. A gaming machine comprising:

an input device to receive a wager to play a game;

a reel controller;

a reel including a plurality of symbols associated with the game; and a reel driver responsive to a plurality of drive signals from the reel controller to drive the reel based on motion parameters associated with a spin profile for the reel, the motion parameters including an initial velocity, a final velocity, and a time to reach the final velocity from the initial velocity, the reel controller configured to calculate, in real time, time intervals between the drive signals based on the initial velocity, the final velocity, and the time to reach the final velocity from the initial velocity;

a processor;

a memory coupled to the processor via a data bus, wherein information regarding the motion parameters is provided to the reel controller using the data bus.

11. The gaming machine of claim 10, wherein the reel controller is coupled to the data bus by a peripheral bus.

12. The gaming machine of claim 10, wherein the motion parameters are processed using the processor and memory.

13. The gaming machine of claim 10, wherein the memory stores motion parameters associated with a number of games.

14. The gaming machine of claim 10, wherein the processor calculates the motion parameters in real time.

15. The gaming machine of claim 10, wherein the reel controller uses the motion parameters to linearly interpolate velocities to approximate the spin profile.

16. A method comprising:

providing a set of motion parameters in a reel controller of a gaming machine, the gaming machine having an input device to receive a wager to play a game and a reel including a plurality of symbols associated with the game, the set of motion parameters including an initial velocity, a final velocity, and a time to reach the final velocity from the initial velocity, the set of motion parameters associated with a spin profile for the reel and a curve that approximates the spin profile;

calculating, in real time, time intervals between drive signals for the reel based on the initial velocity, the final velocity, and the time to reach the final velocity from the initial velocity; and driving the reel based on the calculated time intervals.

17. The method of claim 16, wherein the method further includes calculating the set of motion parameters using a processor.

18. The method of claim 16, wherein the method further includes calculating the set of motion parameters in the reel controller.

19. The method of claim 16, wherein providing a set of motion parameters includes providing a basis for calculating the set of motion parameters for each game associated with the gaming machine.

20. The method of claim 16, wherein providing a set of motion parameters includes calculating the set of motion parameters in real time.

21. The method of claim 16, wherein providing a set of motion parameters includes providing a set of motion parameters that defines line segments as the curve that approximates the spin profile for the reel.

22. The method of claim 21, wherein providing the set of motion parameters that defines line segments that approximate the spin profile for the reel includes reading initial motion parameters from a memory.

23. The method of claim 21, wherein providing the set of motion parameters that defines line segments that approximate the spin profile for the reel includes calculating points on the line segments using an initial velocity and acceleration.

* * * * *

UNITED STATES PATENT AND TRADEMARK OFFICE

CERTIFICATE OF CORRECTION

PATENT NO. : 7,360,761 B2
APPLICATION NO. : 11/159767
DATED : April 22, 2008
INVENTOR(S) : Durham et al.

It is certified that error appears in the above-identified patent and that said Letters Patent is hereby corrected as shown below:

In column 1, line 6, after "U.S.C." insert -- § --.

In column 5, line 12, delete "$(t_0+1/v_{0,\ v0}+1/dt_0)$" and insert -- $(t_0+1/v_0,\ v_0+1/dt_0)$ --, therefor.

In column 9, line 30, In Claim 3, after "machine" insert -- of --.-

Signed and Sealed this

Twenty-sixth Day of August, 2008

JON W. DUDAS
*Director of the United States Patent and Trademark Office*